US010863824B2

(12) United States Patent
Zhang

(10) Patent No.: US 10,863,824 B2
(45) Date of Patent: Dec. 15, 2020

(54) INTERACTIVE DRAWER-FASTENING MECHANISM

(71) Applicant: Jiangsu Tongrun Equipment Technology Co., Ltd., Jiangsu (CN)

(72) Inventor: Feng Zhang, Jiangsu (CN)

(73) Assignee: JIANGSU TONGRUN EQUIPMENT TECHNOLOGY CO., LTD., Jiangsu (CN)

( * ) Notice: Subject to any disclaimer, the term of this patent is extended or adjusted under 35 U.S.C. 154(b) by 246 days.

(21) Appl. No.: 15/541,788

(22) PCT Filed: Jul. 3, 2017

(86) PCT No.: PCT/CN2017/091458
§ 371 (c)(1),
(2) Date: Jul. 16, 2018

(87) PCT Pub. No.: WO2018/176671
PCT Pub. Date: Oct. 4, 2018

(65) Prior Publication Data

US 2020/0015587 A1 Jan. 16, 2020

(30) Foreign Application Priority Data

Mar. 28, 2017 (CN) ..... 2017 1 01916786

(51) Int. Cl.
*A47B 67/04* (2006.01)
*E05B 65/464* (2017.01)
(Continued)

(52) U.S. Cl.
CPC ..... *A47B 67/04* (2013.01); *E05B 65/464* (2013.01); *E05B 65/468* (2013.01); *A47B 2097/008* (2013.01)

(58) Field of Classification Search
CPC . A47B 67/04; A47B 2097/008; E05B 65/468; E05B 65/464; E05B 65/463
See application file for complete search history.

(56) References Cited

U.S. PATENT DOCUMENTS 4,298,236 A * 11/1981 Laroche ..... E05B 65/464 312/215
5,056,877 A * 10/1991 Westwinkel ..... E05B 65/464 312/217

(Continued)

*Primary Examiner* — Hanh V Tran
(74) *Attorney, Agent, or Firm* — Juan Carlos A. Marquez; Marquez IP Law Office, PLLC

(57) ABSTRACT

The present invention provides an interactive drawer-fastening mechanism, comprising a driving shaft component and a fastening assembly; the driving shaft component including a seat and a driving arm; the fastening assembly including a fastening base, an upper limit block, a lower limit block, and a plurality of sliding block components, the sliding block component including a sliding block, a retaining shaft and a torsion spring, the retaining shaft including an arc plate, an immovable shaft and a movable shaft, wherein the retaining shaft has the immovable shaft. The present invention has the fastening assembly and the driving shaft component as separate modules, and has the slide guide working with the lock component to realize the interactively fastening mechanism. The modularized design on one hand structurally simplifies the fastening mechanism and allows easy installation, and on the other hand effectively enhances the reliability of both interaction and fastening.

12 Claims, 12 Drawing Sheets

(51) Int. Cl.
*E05B 65/468* (2017.01)
*A47B 97/00* (2006.01)

(56) References Cited

U.S. PATENT DOCUMENTS 5,335,986 A * 8/1994 Hartrum ..... E05B 65/463 312/217
5,427,445 A * 6/1995 Mitchell ..... E05B 53/003 312/215
7,144,092 B1 * 12/2006 Chang ..... E05B 65/462 312/217
8,746,816 B2 * 6/2014 Westwinkel ..... E05B 65/464 312/217
2005/0210933 A1 * 9/2005 Wen ..... E05B 65/463 70/78
2006/0197416 A1 * 9/2006 Tsai ..... E05B 65/463 312/217
2007/0284976 A1 * 12/2007 Huang ..... E05B 65/464 312/220
2008/0106175 A1 * 5/2008 Huang ..... E05B 65/464 312/217
2008/0279490 A1 * 11/2008 Holcomb ..... E05B 17/007 384/42
2011/0005283 A1 * 1/2011 Sevillano Gil ..... E05B 65/464 70/85
2012/0242201 A1 * 9/2012 Fulterer ..... A47B 88/40 312/218
2014/0265761 A1 * 9/2014 Ropele ..... E05B 65/464 312/218
2014/0354120 A1 * 12/2014 Milani ..... E05B 65/462 312/218
2014/0354121 A1 * 12/2014 Frison ..... E05B 65/463 312/221
2015/0218859 A1 * 8/2015 Westwinkel ..... E05B 65/464 70/78

* cited by examiner

INTERACTIVE DRAWER-FASTENING MECHANISM

BACKGROUND OF THE INVENTION

1. Technical Field

The present invention relates to mechanical fastening means for drawers, and more particularly to an interactive drawer-fastening mechanism that locks all drawers it links when activated, and only release one said drawer at one time when deactivated.

2. Description of Related Art

Existing fastening structures for multiple drawers can be divided into two types. The first one relates to a simple lock structure that locks and unlocks all the associated drawers simultaneously. The other type also locks all the associated drawers simultaneously but only allows one of the drawers to be drawn out when unlocked, which is also known as an interactive structure. The former type has its disadvantage. That is, when unlocked, all the drawers are unfastened and can be open. Once mutual interference happens, multiple drawers are likely to unintentionally slide out at the same time. It is structurally limited, inconvenient to use and unsafe. This is particularly true when it comes to a multi-drawer tool cabinet placed in an environment subject to vibration or jitter. In this case, an operator has to pay extra caution when he opens the drawers to pick up tools, or two or more drawers may slide out simultaneously and the tool cabinet may topple over due to lose its balance. Consequently, the scattered tools can cause trouble or even incur security incidents. While the second type is effective in addressing the problem associated to the first type, the existing interactive fastening means is structurally complicated yet unreliable, and has relatively short service life.

SUMMARY OF THE INVENTION

The present invention is to solve the technical problem of how to provide an interactive drawer-fastening mechanism whose structure and locking system are simple and reliable to solve the shortcomings of the prior mechanism.

To solve the technical problems mentioned above, the present invention provides an interactive drawer-fastening mechanism, comprising a driving shaft component fixed to drawers in a cabinet and a fastening assembly fixed to the cabinet and perpendicular to a drawing direction of the drawer;

the driving shaft component including a seat and a driving arm rotatably connected to each other, the driving arm having one end thereof provided with a driving shaft that is rotatable with respect to the seat and is perpendicular to a drawing direction of the drawers;

the fastening assembly including a fastening base, an upper limit block, a lower limit block, and a plurality of sliding block components, the upper limit block and the lower limit block being fixed to the fastening base's top and bottom, respectively, the plurality of sliding block components being closely fitted onto the fastening base from top to bottom and being slidable vertically with respect to the fastening base, the sliding block component including a sliding block, a retaining shaft and a torsion spring, the retaining shaft including an arc plate as well as an immovable shaft and a movable shaft that are perpendicular to two ends of the arc plate at an identical side, wherein the retaining shaft has the immovable shaft rotatably received in a round hole of the sliding block so as to form a center of rotation, and has the movable shaft rotatable against the center of rotation, while the torsion spring is fitted between the immovable shaft and the sliding block;

when all the drawers are closed, the driving shaft of the driving shaft component being located between the retaining shaft of one said sliding block component and the sliding block of the lower adjacent sliding block component, each said sliding block component being in its normal state, and a gap A being formed between a top of the topmost sliding block component and the upper limit block;

when any of the drawers is drawn out, the driving shaft of the driving arm fixed to the drawer moving forward with the drawer, thereby driving the sliding block component thereabove to slide upward, making the gap A decrease gradually, and when the driving shaft passes through a gap between the two sliding block components, the drawer being open, and the retaining shaft of the sliding block component biased by the torsion spring starting to rotate to a location between the two sliding block components, so that the gap A remains its state when the drawer is open, where $0 \leq A < D$, and the other driving shafts are prevented from being drawn out, thereby realizing interaction.

In one embodiment of the interactive drawer-fastening mechanism provided by the present invention, wherein the interactive drawer-fastening mechanism further comprises a lock component and a slide guide, the lock component including a lock body and a lock rod, the lock rod having one end thereof connected to the lock body and an opposite end thereof formed with a Z-shaped bend, the slide guide being such installed that it is perpendicular to the fastening assembly with one end thereof received in a notch of the upper limit block of the fastening assembly and with an opposite end thereof connected to the Z-shaped bend of the lock rod so that when the lock body is controlled to drive the lock rod to rotate, the slide guide is driven to slide horizontally with respect to the upper limit block, and when a head of the slide guide enters the gap between the upper limit block and the sliding block components, the sliding block components are prevented from sliding, and all the drawer are prevented from being drawn out, thereby realizing fastening.

In one embodiment of the interactive drawer-fastening mechanism provided by the present invention, wherein the seat of the driving arm comprises a fixing plate and a support plate that are perpendicular to each other, the support plate having one end thereof formed with a first installation hole and having an opposite end formed as an S-shaped structure so as to form a V-shaped gap with the fixing plate, the driving arm including a driving plate and a driving shaft, the driving plate having one end thereof formed with a second installation hole and an opposite end perpendicularly fixed to the driving shaft, the driving arm having the driving plate thereof closely fitting the support plate of the seat so as to be combined by means of the first installation hole and the second installation hole to form a center of rotation, and the driving shaft being inserted into the V-shaped gap of the seat perpendicularly, so as to be rotatable against the center of rotation.

In one embodiment of the interactive drawer-fastening mechanism provided by the present invention, wherein the fixing plate has a plurality of third installation holes arranged in line by which the driving shaft component is fixed to the drawers.

In one embodiment of the interactive drawer-fastening mechanism provided by the present invention, wherein the driving plate has its two ends rounded.

In one embodiment of the interactive drawer-fastening mechanism provided by the present invention, wherein the fastening assembly further comprises a spring fitted between the upper limit block and the sliding block components, so that the plurality of sliding block components fit closely.

In one embodiment of the interactive drawer-fastening mechanism provided by the present invention, wherein the fastening base is of a stick-like structure having a T-shaped section, and comprises a first lateral panel and a second lateral panel that are perpendicularly connected to each other, the second lateral panel being formed with a recess for slidably receiving the sliding block component, the sliding block of the sliding block component being of a column-like structure centrally formed with a round hole for receiving the immovable shaft of the retaining shaft, the round hole having one side thereof extending to form an extended slot for partially receiving the torsion spring, and the sliding block having a salient reverse to the retaining shaft for being received in the recess.

In one embodiment of the interactive drawer-fastening mechanism provided by the present invention, wherein the upper limit block is of an L-shaped structure with a horizontal arm formed with a threaded hole and a vertical arm formed with a notch, in which the notch is greater than or equal to the head of the slide guide in size.

The present invention provides the following beneficial effects. The disclosed interactive drawer-fastening mechanism has the fastening assembly and the driving shaft component pre-assembled as separate modules, and has the slide guide working with the lock component to realize the interactively fastening mechanism. The modularized design on one hand structurally simplifies the fastening mechanism and allows easy installation, and on the other hand effectively enhances the reliability of both interaction and fastening.

DETAILED DESCRIPTION OF THE INVENTION

The invention as well as a preferred mode of use, further objectives and advantages thereof will be best understood by reference to the following detailed description of illustrative embodiments when read in conjunction with the accompanying drawings.

Figure 1:
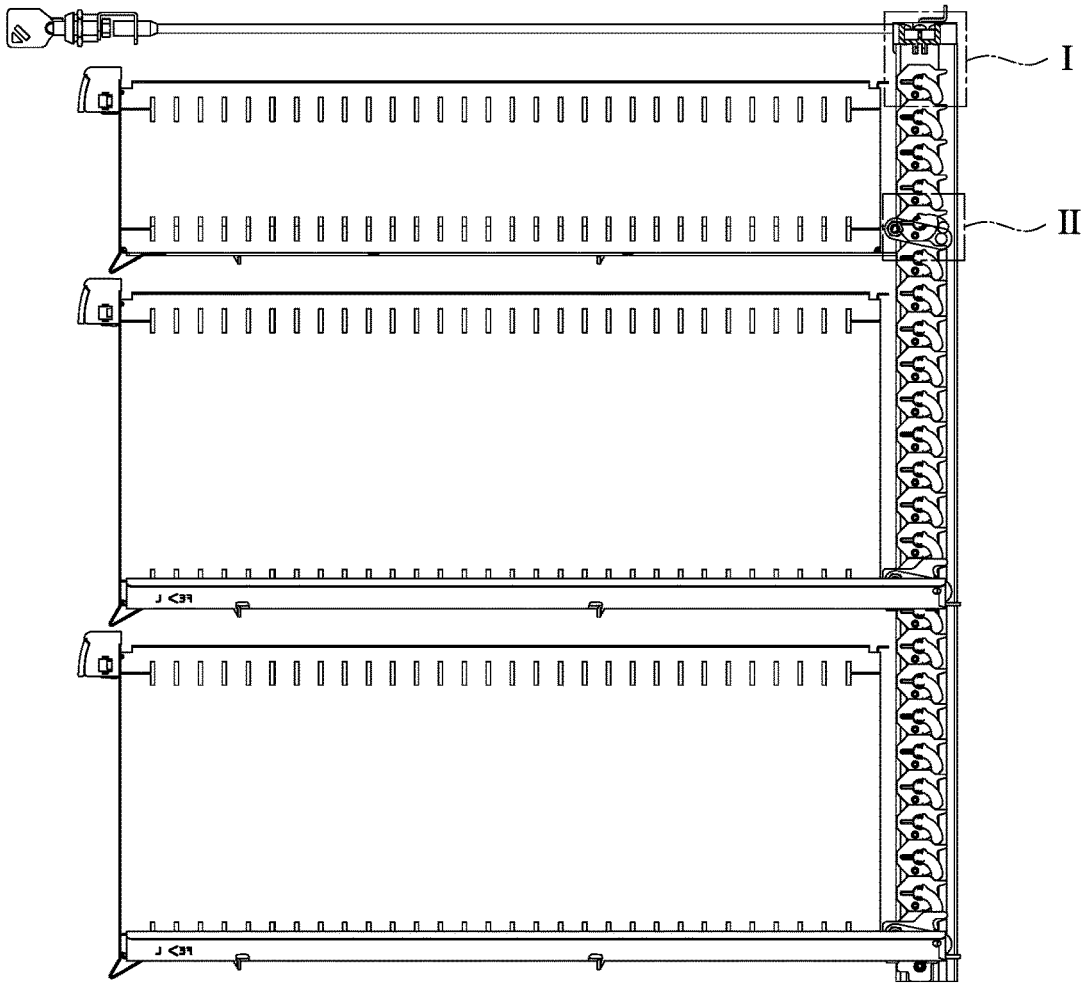
FIG. 1 is a schematic structural view of an interactive drawer-fastening mechanism according to one preferred embodiment of the present invention when closed.
Figure 2:
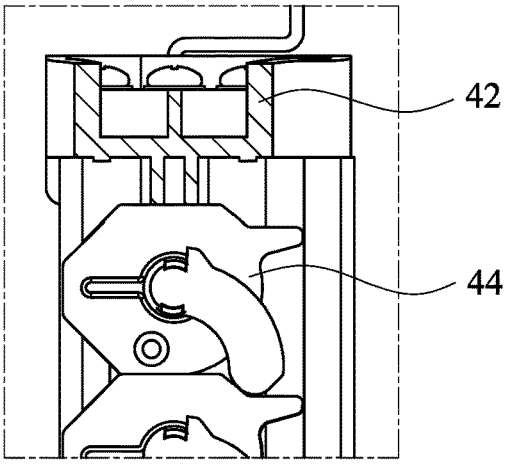
FIG. 2 is a close-up schematic structural view of Area I of FIG. 1.
Figure 3:
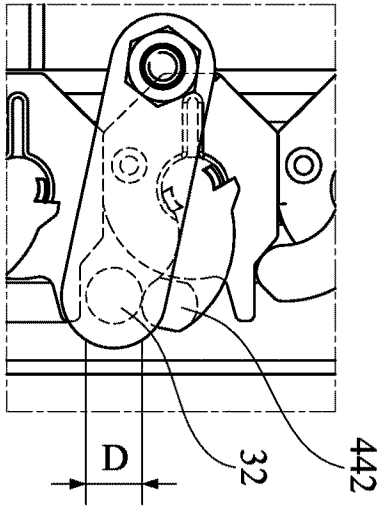
FIG. 3 is a close-up schematic structural view of Area II of FIG. 1.
Figure 4:
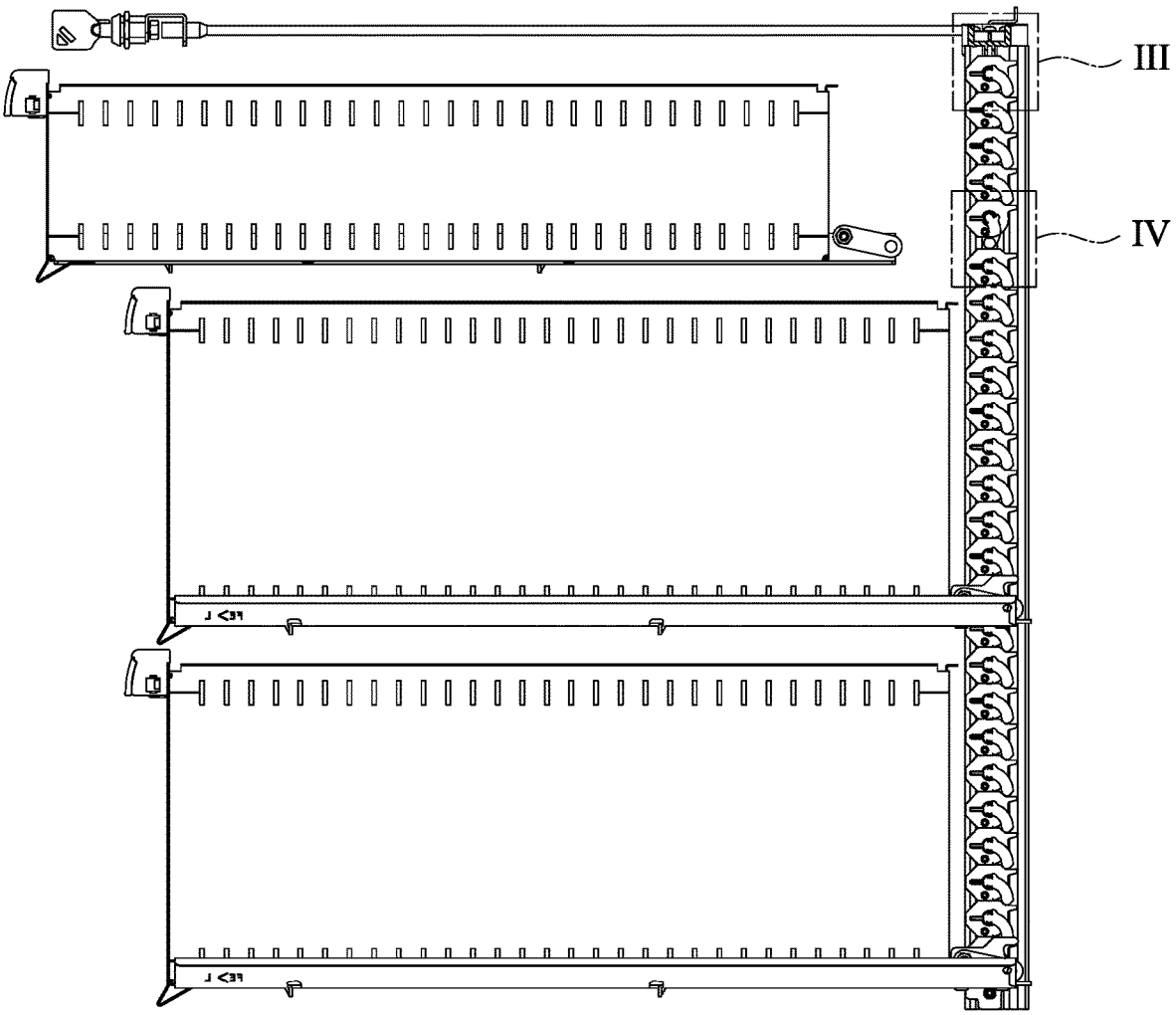
FIG. 4 is a schematic structural view of the interactive drawer-fastening mechanism when open.
Figure 5:
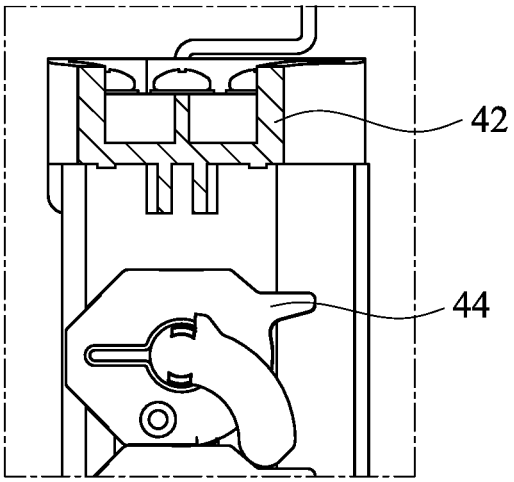
FIG. 5 is a close-up schematic structural view of Area III of FIG. 4.
Figure 6:
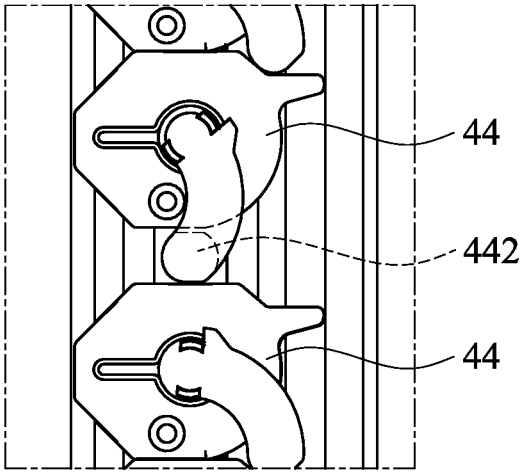
FIG. 6 is a close-up schematic structural view of Area IV of FIG. 4.
Figure 7:
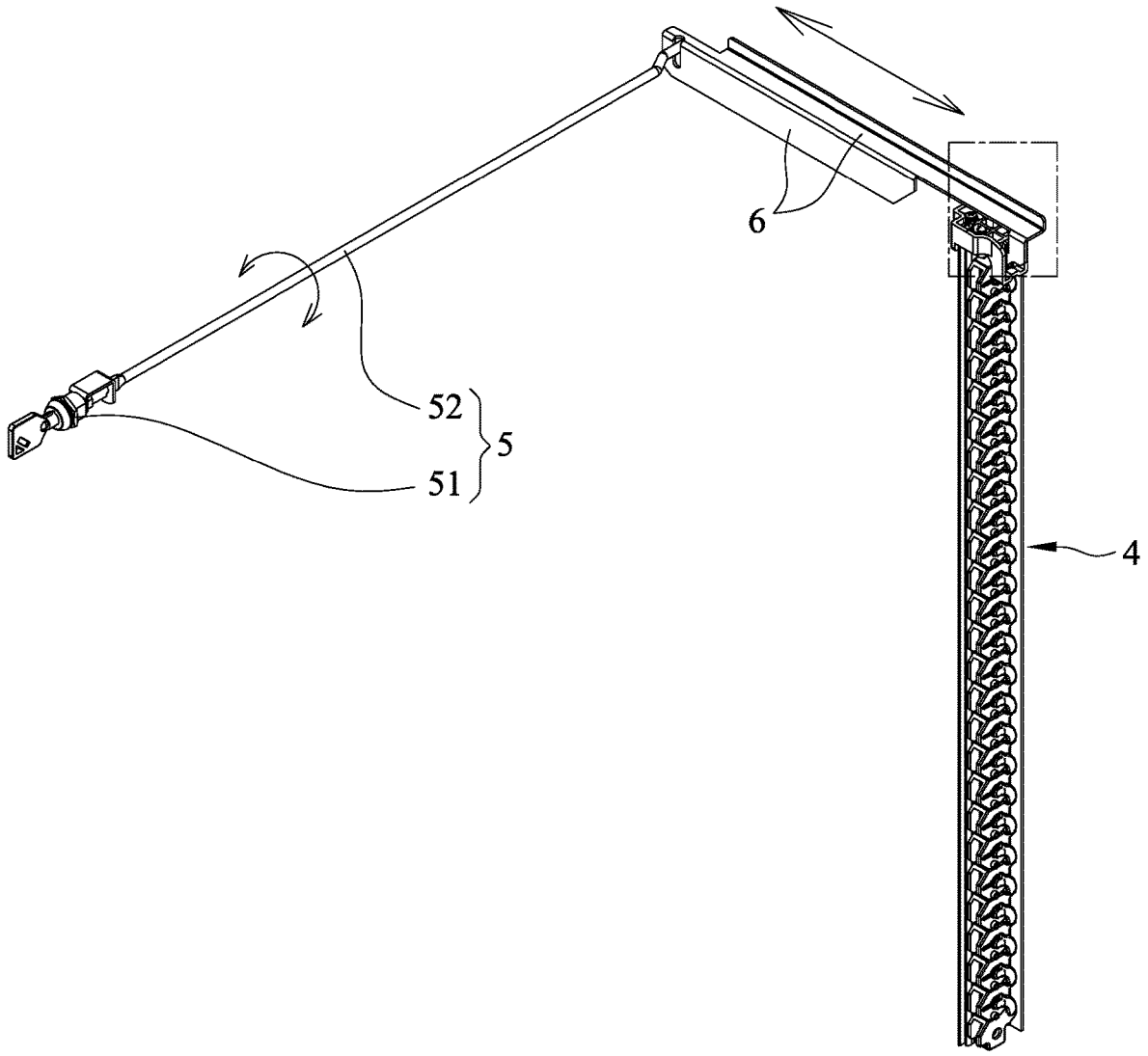
FIG. 7 is a schematic structural view of the mechanism's fastening assembly, slide guide and lock component when assembled.
Figure 8:
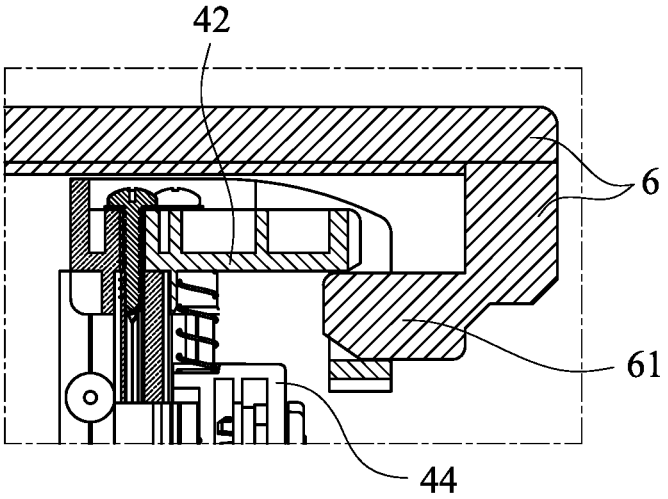
FIG. 8 is a close-up schematic structural view of FIG. 7 when open.
Figure 9:
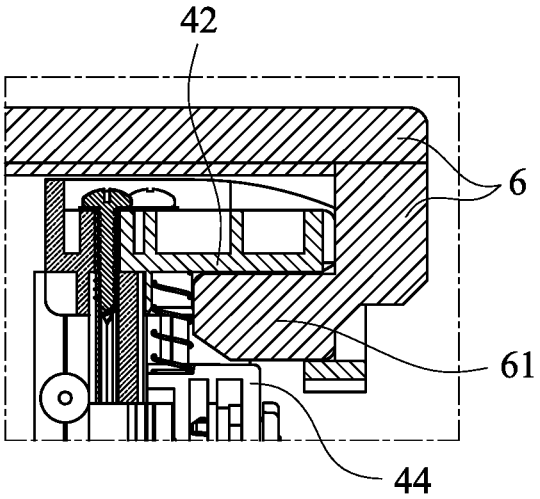
FIG. 9 is a close-up schematic structural view of FIG. 7 when closed.
Figure 10:
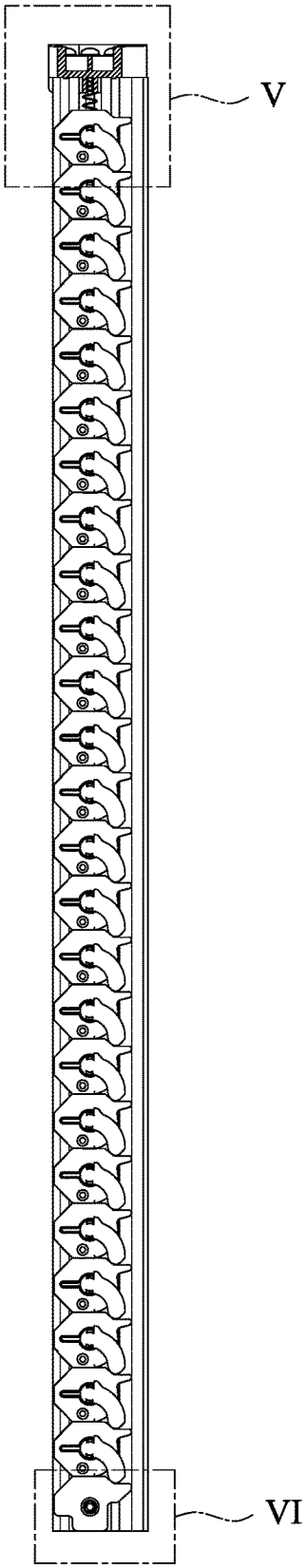
FIG. 10 is a schematic structural view of the fastening assembly.
Figure 11:
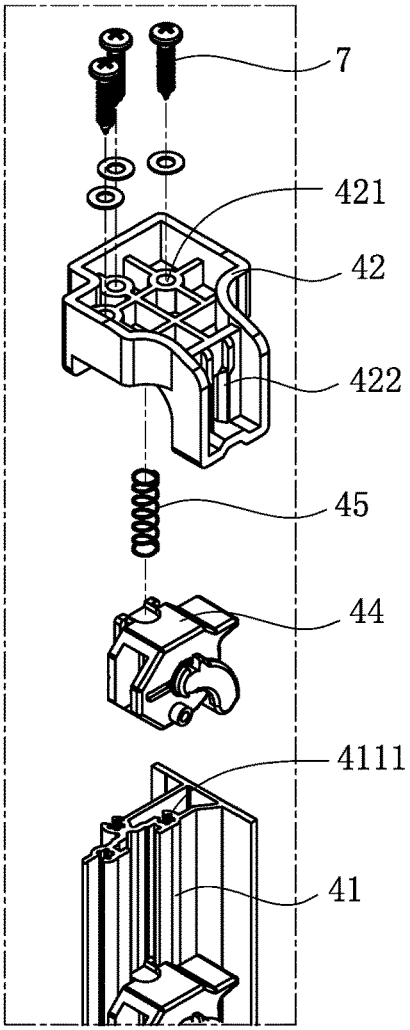
FIG. 11 is an exploded view of Area V of FIG. 10.
Figure 12:
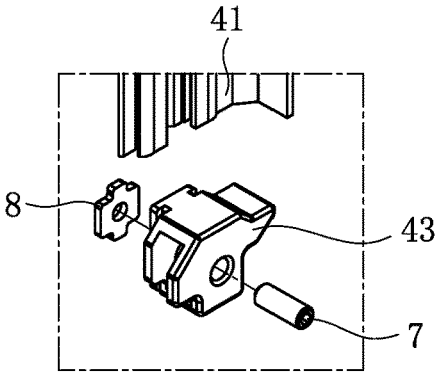
FIG. 12 is an exploded view of Area VI of FIG. 10.
Figure 13:
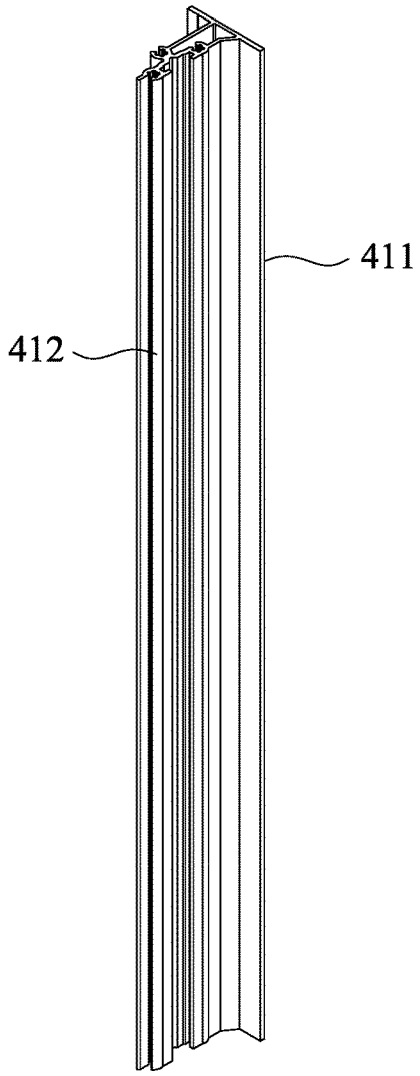
FIG. 13 is a perspective view of the mechanism's fastening base.
Figure 14:
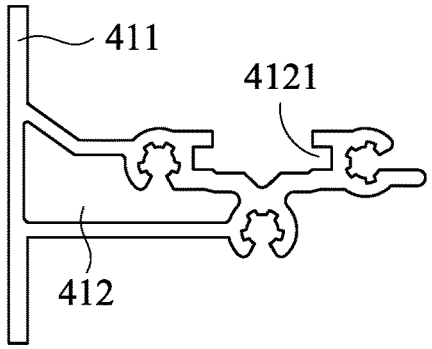
FIG. 14 is a cross-sectional view of the fastening base.
Figure 15:
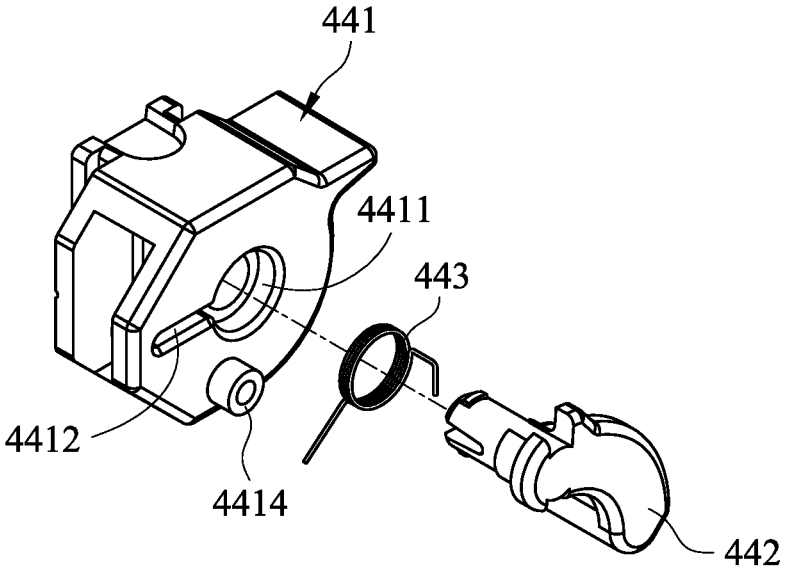
FIG. 15 is an exploded view of the mechanism's sliding block component.
Figure 16:
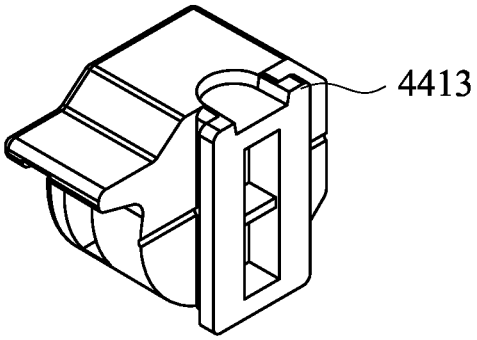
FIG. 16 is a back view of the sliding block.
Figure 17:
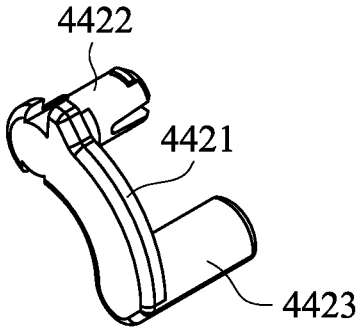
FIG. 17 is a schematic perspective view of the retaining shaft.
Figure 18:
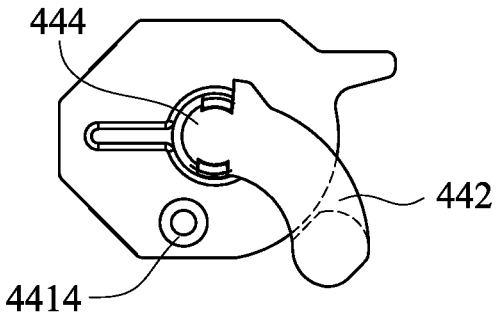
FIG. 18 is a schematic structural view of the sliding block component in its normal state.
Figure 19:
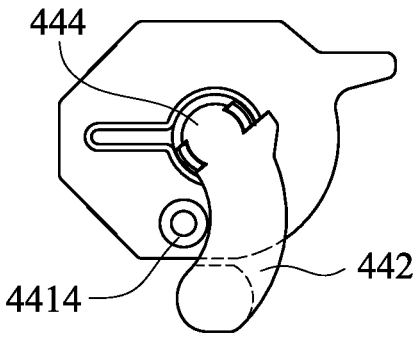
FIG. 19 is a schematic structural view of the sliding block component in its locked state.
Figure 20:
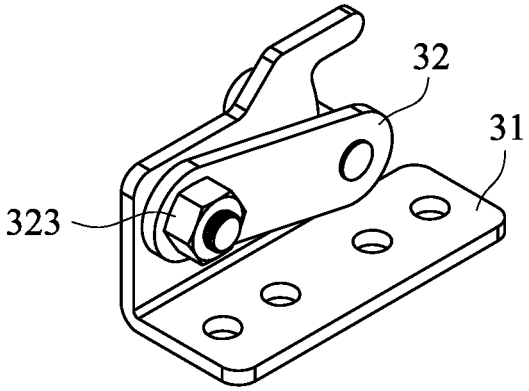
FIG. 20 is a schematic perspective view of the driving shaft component.
Figure 21:
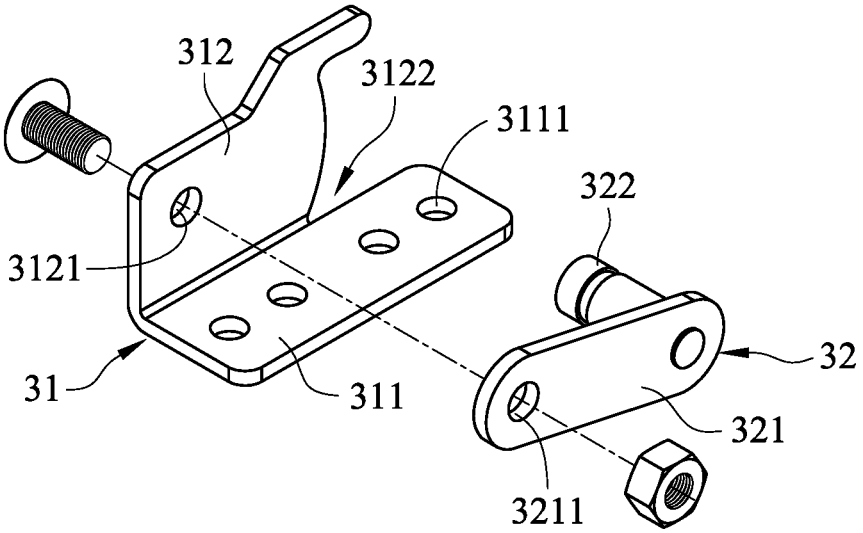
FIG. 21 is an exploded view of the mechanism's driving shaft component.
Figure 22:
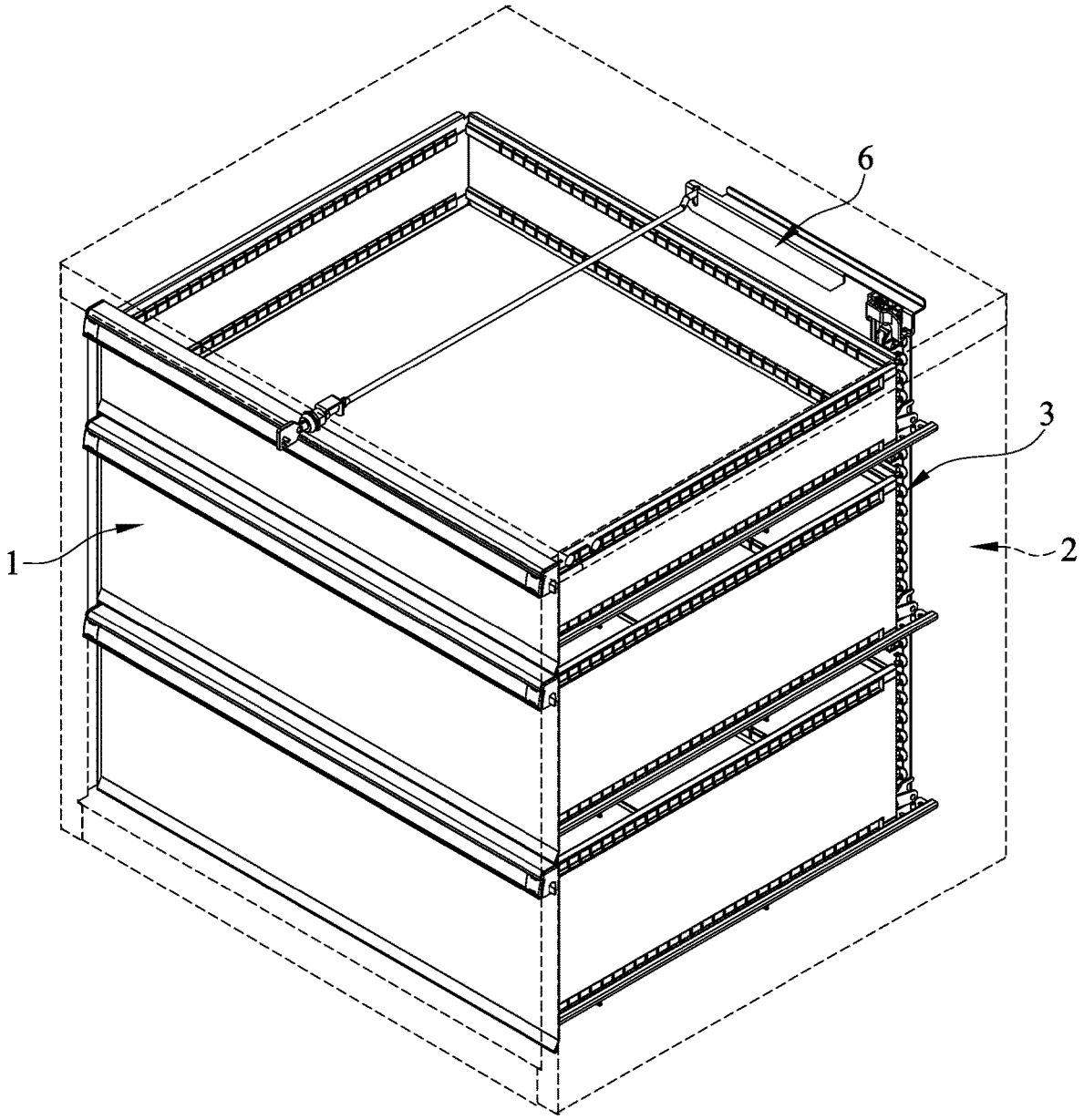
FIG. 22 is an applied view of the disclosed interactive drawer-fastening mechanism that is installed in a cabinet.

One preferred embodiment of the present invention is depicted in FIG. 1 through FIG. 22.

In the embodiment, an interactive drawer-fastening mechanism comprises: a driving shaft component 3 fixed to drawers 1 in a cabinet 2, a fastening assembly 4 fixed to the cabinet 2 and perpendicular to the drawing direction of the drawer 1, a lock component 5, and a slide guide 6 parallel to the upper surface of the cabinet and perpendicular to the fastening assembly 4.

The driving shaft component 3 comprises a seat 31 and a driving arm 32 that are rotatably connected to each other. Therein, the seat comprises a fixing plate 311 and a support plate 312 that are perpendicular to each other. The support plate 312 has its one end provided with a first installation hole 3121, and has its opposite end formed as an S-shaped structure, so that a V-shaped gap 3122 is formed between the support plate 312 and the fixing plate 311. The driving arm 32 comprises a driving plate 321 and a driving shaft 322. The driving plate 321 has its one end formed with a second installation hole 3211, and has its opposite end fixed to and perpendicular to the driving shaft 322. The driving arm 32 has its driving plate 321 fitting close to and combined with the support plate 312 of the seat 31 by means of a screw bolt and a nut (or any other connecting component known in the art) at the first installation hole 3121 and the second installation hole 3211, thereby forming a first center of rotation 323. Meanwhile, the driving shaft 322 is perpendicularly inserted into the V-shaped gap 3122 of the seat 31, so as to be up-and-down rotatable against the center of rotation 323. The fixing plate 311 is formed with a plurality of (two to four) third installation holes 3111 arranged in line, by which the driving shaft component 3 is fixed to the drawer 1. In addition, the driving plate 321 has its two ends each formed as a rounded end so as to provide the driving shaft 322 with the greatest possible space of rotation.

The driving arm 3 is such assembled that the driving shaft 322 is perpendicular to the drawer drawing direction, or is parallel to the drawer's facade, and is rotatable with respect to the seat.

The fastening assembly 4 comprises a fastening base 41, an upper limit block 42, a lower limit block 43, a plurality of sliding block components 44, and a spring 45. Therein, the upper limit block 42 is fixed to the top of the fastening base 41 by means of a screw bolt (or any other fixing means known in the art). The lower limit block 43 is fixed to the bottom of the fastening base 41 by means of a screw bolt and a nut plate (or any other fixing means known in the art). The a plurality of the sliding block component 44 are closely fitted to the fastening base 41 successively from top and are slidable with respect to the fastening base. The spring 45 is arranged between the upper limit block 42 and the topmost sliding block component 44, for keeping the adjacent sliding block components closely fitted in position. In the assembled fastening assembly 4, the distance between the upper limit block 42 and the lower limit block 43 is H=h+h+ . . . +h+h+A, where h is the height of each said sliding block component, and A is the distance between the upper limit block and the topmost sliding block component.

Particularly, the fastening base 41 is a stick having a T-shaped section, and composed of a first lateral panel 411 and a second lateral panel 412 that are perpendicularly connected. The first lateral panel 411 is atop formed with a threaded hole 4111 for connecting the upper limit block 42. The second lateral panel 412 is formed with a recess 4121 for receiving the sliding block components 44 to slide therein. The recess 4121 is a T-shaped groove or any other connected through commonly used in the art.

The sliding block component 44 comprises a sliding block 441, a retaining shaft 442, and a torsion spring 443. Therein, the sliding block 441 is of a column-like structure centrally formed with a round hole 4411. The round hole is extended with an extended slot 4412 at its one side. The retaining shaft 442 comprises arc plate 4421 as well as an immovable shaft 4422 and a movable shaft 4423 that are perpendicular to two ends at the same side of the arc plate 4421, respectively. Therein, the retaining shaft 442 has its immovable shaft 4422 received in the round hole 4411 of the sliding block 441 and is rotatable with respect to the sliding block 441, thereby forming a second center of rotation 444. The torsion spring 443 is arranged between the immovable shaft 4422 and the sliding block 441, and is partially received in the extended slot 4412, so as to ensure prompt and reliable restoration of the retaining shaft 442. The movable shaft 4423 of the retaining shaft 442 rotates against the second center of rotation 444. Additionally, the sliding block 441 has a salient 4413 formed at its side reverse to the retaining shaft 442. The salient 4413 is configured to match the recess 4121 of the fastening base 41 in size and in geometry, for combining the sliding block component 44 with the fastening base 41. The sliding block 441 has a retaining node 4414 at its opposite side. The retaining node is located left lower the round hole, for defining a lower limit of rotation for the retaining shaft. When the movable shaft of the retaining shaft rotates to the retaining node, interaction is established.

The upper limit block 42 is L-shaped, with is horizontal arm having a through hole 421, for a screw bolt 423 to pass thereby having the upper limit block fixed to the top of the fastening base 41. A vertical arm of the upper limit block 42 has a notch 422, which is greater than or equal to the slide guide head 61 in size.

The fastening assembly 4 is such installed that it is perpendicular to the driving shaft 322 when upright installed in the cabinet 2.

The lock component 5 comprises a lock body 51 and a lock rod 52. The lock rod 52 has one end connected to the lock body 51, and has the opposite end formed as a Z-shaped bend.

The slide guide 6 has one end (relatively close to the head) received in the notch 422 of the upper limit block 42 of the fastening assembly 4, and its opposite end is connected to the Z-shaped bend of the lock rod 52. The slide guide head 61 is smaller or equal to the notch 422 in size so as to ensure that the slide guide head passes through the notch 422 smoothly and has easy access to the gap between the upper limit block 42 and the topmost sliding block component 44. (滑动组件 44/滑块组件 44)

The principle behind the interaction formed by the interactive drawer-fastening mechanism is described below.

When all the drawers are closed, the driving shaft of the driving shaft component is located between the retaining shaft of an upper said sliding block component and the sliding block of the adjacent lower sliding block component, and each of the sliding block components is in its normal state. A gap A is formed between the top of the topmost sliding block component and the upper limit block.

When any of the drawers is drawn out, the driving shaft of the driving arm fixed to that drawer moves forward with the drawer, thereby driving the sliding block of the sliding block component above it to slide upward, so that a distance starts to form between the sliding blocks of the two adjacent sliding block components as the gap A diminishes gradually. As a result, the retaining shaft begins to rotate. When the distance between the two sliding blocks is large enough for the driving shaft to pass therethrough, the retaining shaft biased by the torsion spring rotates downward to a location between the two sliding blocks, thereby establishing interaction. At this time, the drawer is drawn out, the gap A remains its state when the drawer is open, where $0 \leq A < D$ (D is the diameter of the driving shaft), and all the sliding blocks are prevented from sliding any more or are limited to slide for a distance smaller than the diameter D of the driving shaft. Thus, the driving shaft is held from being pulled out, so the other drawers are held closed, thereby accomplish the desired interaction.

The interactive drawer-fastening mechanism enables fastening in virtue of the principle described below.

When the lock body (or the fastening mechanism) is open, the slide guide head is away from the gap between the upper limit block and the topmost sliding block component. At this time, the sliding block component is slidable, and any of the drawers can be drawn out.

When the lock body is operated, the lock rod rotates and drives the slide guide to slide horizontally with respect to the upper limit block. Then when the slide guide head enters the gap between the upper limit block and the topmost sliding block component, the sliding block component is unslidable, so all the drawers are locked from being opened, or are fastened.

The present invention has the fastening assembly and the driving shaft component pre-assembled as separate modules, and has the slide guide working with the lock component to realize the interactively fastening mechanism. The modularized design on one hand structurally simplifies the fastening mechanism and allows easy installation, and on the other hand effectively enhances the reliability of both interaction and fastening.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An interactive drawer-fastening mechanism, comprising a driving shaft component fixed to a respective drawer in a cabinet and a fastening assembly fixed to the cabinet and perpendicular to a drawing direction of the drawer;

the driving shaft component including a seat and a driving arm rotatably connected to each other, the driving arm having one end thereof provided with a driving shaft that is rotatable with respect to the seat and is perpendicular to a drawing direction of the drawers;

the fastening assembly including a fastening base, an upper limit block, a lower limit block, and a plurality of sliding block components, the upper limit block and the lower limit block being fixed to the fastening base's top and bottom, respectively, the plurality of sliding block components being closely fitted onto the fastening base from top to bottom and being slid vertically with respect to the fastening base, each of the plurality of sliding block components including a sliding block, a retaining shaft and a torsion spring, the retaining shaft including an arc plate as well as an immovable shaft and a movable shaft that are perpendicular to two ends of the arc plate at an identical side, wherein the retaining shaft has the immovable shaft rotatably received in a round hole of the sliding block so as to form a center of rotation, and has the movable shaft rotatable against the center of rotation, while the torsion spring is fitted between the immovable shaft and the sliding block;

when all the drawers are closed, the driving shaft of the driving shaft component being located between the retaining shaft of one said sliding block component and the sliding block of the lower adjacent sliding block component, each said sliding block component being in its normal state, and a gap A being formed between a top of the topmost sliding block component and the upper limit block;

when any of the drawers is drawn out, the driving shaft of the driving arm fixed to the drawer moving forward with the drawer, thereby driving the sliding block component thereabove to slide upward, making the gap A decrease gradually, and when the driving shaft passes through a gap between the two sliding block components, the drawer being open, and the retaining shaft of the sliding block component biased by the torsion spring starting to rotate to a location between the two sliding block components, so that the gap A remains its state when the drawer is open, where $0 \leq A < D$, and the other driving shafts are prevented from being drawn out, thereby realizing interaction;

wherein D is a diameter of the driving shaft.

2. The interactive drawer-fastening mechanism of claim 1, wherein the interactive drawer-fastening mechanism further comprises a lock component and a slide guide, the lock component including a lock body and a lock rod, the lock rod having one end thereof connected to the lock body and an opposite end thereof formed with a Z-shaped bend, the slide guide being such installed that it is perpendicular to the fastening assembly with one end thereof received in a notch of the upper limit block of the fastening assembly and with an opposite end thereof connected to the Z-shaped bend of the lock rod so that when the lock body is controlled to drive the lock rod to rotate, the slide guide is driven to slide horizontally with respect to the upper limit block, and when a head of the slide guide enters the gap between the upper limit block and the sliding block components, the sliding block components are prevented from sliding, and all the drawers are prevented from being drawn out, thereby realizing fastening.

3. The interactive drawer-fastening mechanism of claim 1, wherein the driving arm comprises a fixing plate and a support plate that are perpendicular to each other, the support plate having one end thereof formed with a first installation hole and having an opposite end formed as an S-shaped structure so as to form a V-shaped gap with the fixing plate, the driving arm including a driving plate and a driving shaft, the driving plate having one end thereof formed with a second installation hole and an opposite end perpendicularly fixed to the driving shaft, the driving arm having the driving plate thereof closely fitting the support plate of the seat so as to be combined by means of the first installation hole and the second installation hole to form a center of rotation, and the driving shaft being inserted into the V-shaped gap of the seat perpendicularly, so as to be rotatable against the center of rotation.

4. The interactive drawer-fastening mechanism of claim 2, wherein the driving arm comprises a fixing plate and a support plate that are perpendicular to each other, the support plate having one end thereof formed with a first installation hole and having an opposite end formed as an S-shaped structure so as to form a V-shaped gap with the fixing plate, the driving arm including a driving plate and a driving shaft, the driving plate having one end thereof formed with a second installation hole and an opposite end perpendicularly fixed to the driving shaft, the driving arm having the driving plate thereof closely fitting the support plate of the seat so as to be combined by means of the first installation hole and the second installation hole to form a center of rotation, and the driving shaft being inserted into the V-shaped gap of the seat perpendicularly, so as to be rotatable against the center of rotation.

5. The interactive drawer-fastening mechanism of claim 3, wherein the fixing plate has a plurality of third installation holes arranged in line by which the driving shaft component is fixed to the drawer.

6. The interactive drawer-fastening mechanism of claim 4, wherein the fixing plate has a plurality of third installation holes arranged in line by which the driving shaft component is fixed to the drawer.

7. The interactive drawer-fastening mechanism of claim 3, wherein the driving plate has its two ends rounded.

8. The interactive drawer-fastening mechanism of claim 4, wherein the driving plate has its two ends rounded.

9. The interactive drawer-fastening mechanism of claim 1, wherein the fastening assembly further comprises a spring fitted between the upper limit block and the sliding block components, so that the plurality of sliding block components fit closely.

10. The interactive drawer-fastening mechanism of claim 2, wherein the fastening assembly further comprises a spring fitted between the upper limit block and the sliding block components, so that the plurality of sliding block components fit closely.

11. The interactive drawer-fastening mechanism of claim 1, wherein the fastening base is of a stick-like structure having a T-shaped section, and comprises a first lateral panel and a second lateral panel that are perpendicularly connected to each other, the second lateral panel being formed with a recess for slid receiving the plurality of sliding block components, the sliding block of each of the plurality of sliding block components being of a column-like structure centrally formed with a round hole for receiving the immovable shaft of the retaining shaft, the round hole having one side thereof extending to form an extended slot for partially receiving the torsion spring, and the sliding block having a salient reverse to the retaining shaft for being received in the recess.

12. The interactive drawer-fastening mechanism of claim 2, wherein the upper limit block is of an L-shaped structure with a horizontal arm formed with a threaded hole and a vertical arm formed with a notch, in which the notch is greater than or equal to the head of the slide guide in size.

* * * * *